US012264412B2

(12) United States Patent
Mohite et al.

(10) Patent No.: US 12,264,412 B2
(45) Date of Patent: Apr. 1, 2025

(54) PROCESS FOR MANUFACTURING LYOCELL FILAMENT YARN AND AN APPARATUS THEREOF

(71) Applicants: Aditya Birla Science and Technology Company Pvt. Ltd., Maharashtra (IN); Grasim Industries Ltd., Madhya Pradesh (IN)

(72) Inventors: Lalaso Vishnu Mohite, Maharashtra (IN); Shailesh Prakash Nagarkar, Maharashtra (IN); Santosh Shivaji Shingote, Maharashtra (IN); Shirish Sheshrao Thakre, Maharashtra (IN); Suvankar Madhusudan Dutta, Maharashtra (IN); Bandu Madhukar Kale, Gujarat (IN); Roop Kishore Sharma, Gujarat (IN); Manishkumar Govindbhai Limbani, Gujarat (IN); Srivastava Pankaj, Girsomnath (IN); Harendra Singh Dagur, Gujarat (IN)

(73) Assignees: ADITYA BIRLA SCIENCE AND TECHNOLOGY COMPANY PVT. LTD., Maharashtra (IN); GRASIM INDUSTRIES LTD., Madhya Pradesh (IN)

( * ) Notice: Subject to any disclaimer, the term of this patent is extended or adjusted under 35 U.S.C. 154(b) by 459 days.

(21) Appl. No.: 17/607,987

(22) PCT Filed: Apr. 30, 2020

(86) PCT No.: PCT/IN2020/050395
§ 371 (c)(1),
(2) Date: Nov. 1, 2021

(87) PCT Pub. No.: WO2020/222258
PCT Pub. Date: Nov. 5, 2020

(65) Prior Publication Data

US 2022/0290329 A1 Sep. 15, 2022

(30) Foreign Application Priority Data

Apr. 30, 2019 (IN) ..... 201921012927

(51) Int. Cl.
*D01D 5/00* (2006.01)
*D01D 5/06* (2006.01)
(Continued)

(52) U.S. Cl.
CPC ..... *D01D 5/06* (2013.01); *D01D 10/06* (2013.01); *D01F 2/00* (2013.01); *D02J 1/223* (2013.01)

(58) Field of Classification Search
CPC ..... D01D 5/06
See application file for complete search history.

(56) References Cited

U.S. PATENT DOCUMENTS 2,798,283 A * 7/1957 Magat ..... D01D 5/06 428/397
3,088,793 A * 5/1963 Knudsen ..... D01F 6/18 28/220

(Continued)

FOREIGN PATENT DOCUMENTS

EP 3467161 A1 * 4/2019 ..... B29C 48/05
KR 100792622 B1 * 1/2008 ..... D06B 3/04

OTHER PUBLICATIONS

KR-100792622 (Woo) 2008-0p (online machine translation), [Retrieved on Apr. 3, 2024]. Retrieved from: Espacenet (Year: 2008).*

*Primary Examiner* — Alison L Hindenlang
*Assistant Examiner* — Andres E. Behrens, Jr.
(74) *Attorney, Agent, or Firm* — SALIWANCHIK, LLOYD & EISENSCHENK

(57) ABSTRACT

The present invention relates to a process for manufacturing lyocell filament yarn with improved mechanical properties and an apparatus thereof. The process involves washing of (Continued)

filament yarn with sequential decrease in NMMO concentrations and filament yarn drying under relaxed conditions. Additionally, the present invention also provides a compact washing and drying apparatus that uses controlled air gap spinning thereby resulting in production of LFY under relaxed conditions and also having a higher mechanical properties & productivity.

11 Claims, 2 Drawing Sheets

(51) Int. Cl.

| | |
|---|---|
| ***D01D 10/00*** | (2006.01) |
| ***D01D 10/06*** | (2006.01) |
| ***D01F 2/00*** | (2006.01) |
| ***D02J 1/00*** | (2006.01) |
| ***D02J 1/22*** | (2006.01) |

(56) References Cited

U.S. PATENT DOCUMENTS

| | | | | |
|---|---|---|---|---|
| 4,246,221 | A * | 1/1981 | McCorsley, III | C08J 3/096 264/210.8 |
| 6,183,865 | B1 * | 2/2001 | Yabuki | D01F 2/00 428/364 |
| 8,952,146 | B2 * | 2/2015 | Kapoor | D01F 2/02 536/124 |
| 2008/0275231 | A1 * | 11/2008 | Zhang | D01F 2/02 422/187 |
| 2014/0291887 | A1 * | 10/2014 | Coan | B01D 53/228 264/203 |
| 2020/0031886 | A1 * | 1/2020 | Morinaga | D02J 1/222 |
| 2020/0332442 | A1 * | 10/2020 | Schrempf | D01D 7/00 |
| 2022/0081803 | A1 * | 3/2022 | Pillichshammer | D01D 5/06 |

* cited by examiner

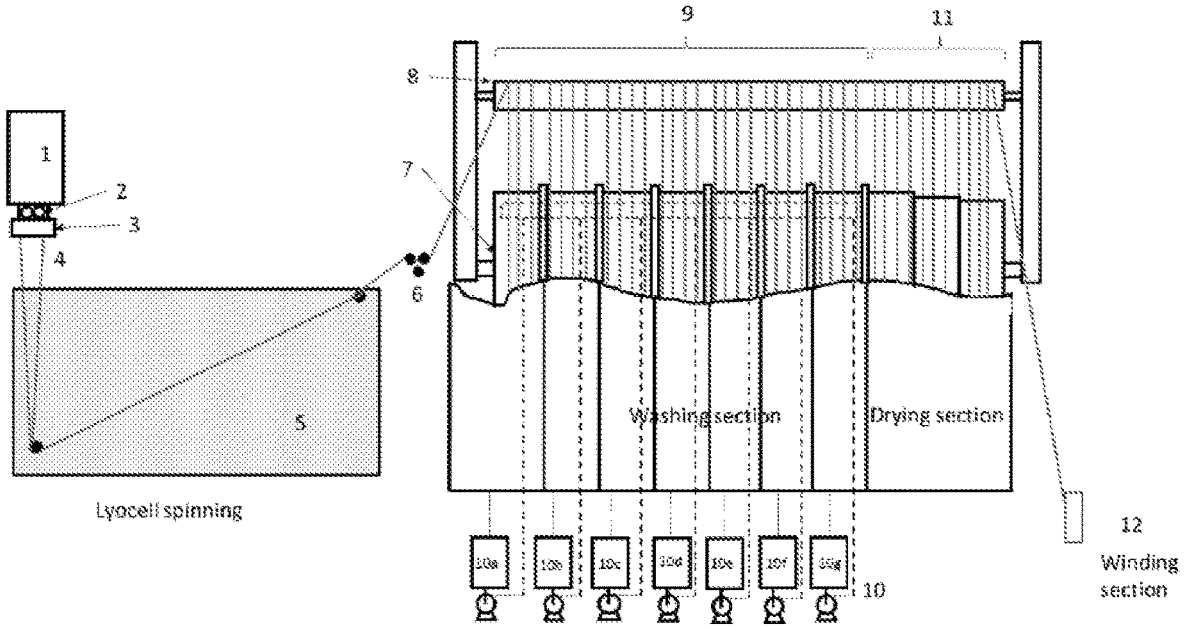
Figure 1: Lyocell filament yarn process

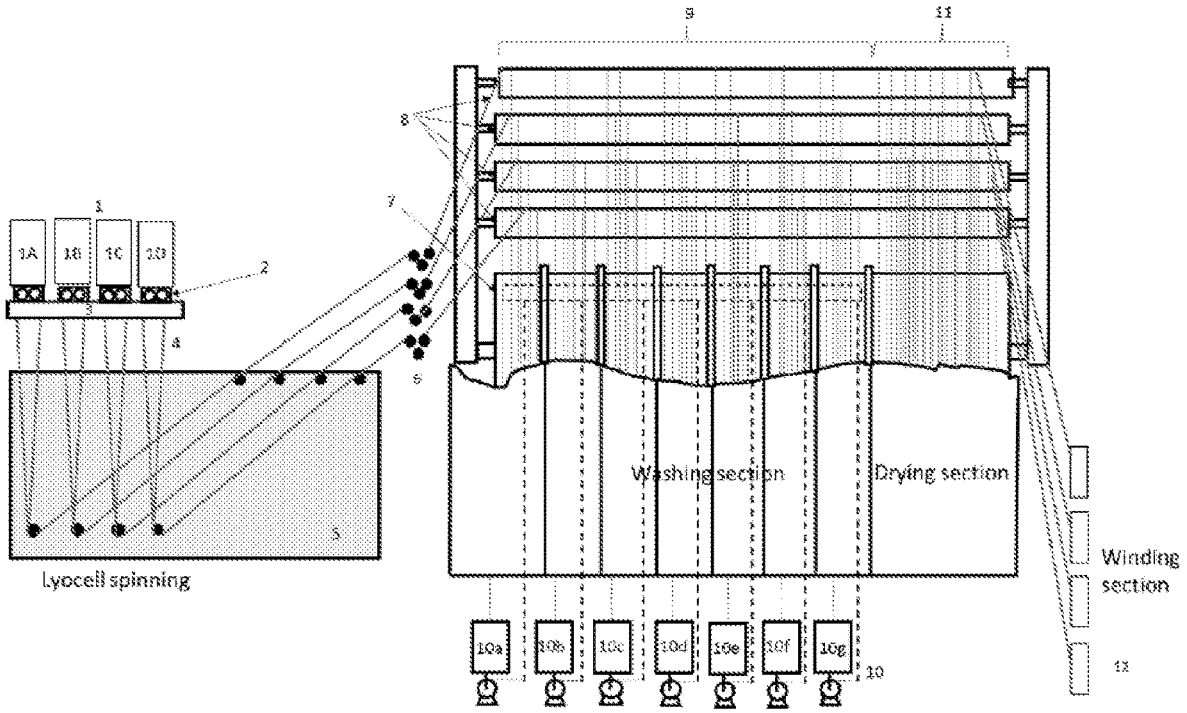
Figure 2: Apparatus for multiple Lyocell filament yarn

PROCESS FOR MANUFACTURING LYOCELL FILAMENT YARN AND AN APPARATUS THEREOF

CROSS REFERENCE TO RELATED APPLICATIONS

This application is a National Stage Application of International Application Number PCT/IN2020/050395, filed Apr. 30, 2020; which claims priority to Indian application No. 201921012927, filed Apr. 30, 2019.

FIELD OF THE INVENTION

The present invention relates to a process for manufacturing of Lyocell filament yarn. More particularly, the present invention provides a continuous process to manufacture a Lyocell filament yarn with improved mechanical properties. The present invention also relates to a novel apparatus for carrying out the said process.

BACKGROUND OF THE INVENTION

Generally, the manufacture of Lyocell filament yarn (LFY) is a multi-step process that involves preparation of a homogeneous cellulose solution by swelling a cellulose pulp with concentrated liquid N-methyl morpholine N-oxide (NMMO) followed by extruded-spinning of the cellulose solution through an air gap using a spinning nozzle having 1 to 2000 orifices in order to obtain filament yarn. The filament yarn is further regenerated in aqueous N-methyl morpholine N-oxide (NMMO) solution to yield filament yarn that is then washed, dried and treated with a finishing oil and wound on bobbin.

The existing process for manufacturing LFY provides a filament yarn that has an elongation of less than 7% that is suitable for tyre cord application but may not suitable for many textile applications. Many existing processes also uses temperature of over 100° C. for filament yarn drying. These reported processes are lengthy, multistep and require large plant footprint with many operations and equipment's such as number of washing zones, winders, dryers, etc. There are a few reports that disclose increase in the elongation of filament yarn using a spinneret with lower ration of length to diameter (L/D) of spinneret and high Degree of Polymerization (DP>800) of cellulose pulp. However, these approaches are not good enough for stable spinning as they lead to breakage of filament.

Moreover, it has been reported that incomplete shear orientation of cellulose chain occurs in the spinneret of lower L/D. This results in lower mechanical properties in the Lyocell filament yarn. High pulp DP results in higher viscosity of Lyocell solutions. This further increases the pressure drop in the spinning process affecting the process efficiency.

Furthermore, the existing prior art reports production of LFY using conventional processes of Lyocell spinning with multiple washing and drying stages in a series. However, they result in lower productivity and also require separation of filament washing and drying steps. There are reported processes that remove NMMO from the filament by passing it through the wash bath. These processes are complex as they require varying the concentration of aqueous solution of NMMO in bath, through the multiple wash baths resulting in bigger plant footprint.

Therefore, there is a need of a process and an apparatus that solves some of the problems of the prior art.

SUMMARY OF THE INVENTION

According to an embodiment of the present invention, there is provided a process for manufacturing lyocell filament yarn with improved mechanical properties, the process comprising:

a. preparing a homogenous solution of cellulose in concentrated NMMO solution to obtain cellulose dope, and storing said cellulose dope in a lyocell dope vessel (1);
b. pumping stored cellulose dope via a metering pump (2) into a spin pack (3) containing a spinneret that extrudes the cellulose dope as spun filaments;
c. stretching extruded spun filament yarn using a winder (6) while passing filaments through an air-gap (4) at controlled conditions and in a regeneration bath (5) containing a solution for partial regeneration of the extruded spun filament yarn;
d. guiding the partially regenerated filament yarn to filament guiding drum (8) which passes said filament yarn to a main drum (7) spinning at a speed less than the winder (6) speed, said main drum (7) having a filament yarn washing section (9) and a filament yarn drying section (11) wherein the filament yarn is fully regenerated in the filament yarn washing section (9) by passing it through sequential washing zones, each successive washing zone containing a washing solution of successively decreasing concentration of NMMO, said concentration successively decreasing up to 0% by weight of NMMO in filament, maintained by circulating system (10), and
e. drying the washed filament yarn on the filament yarn drying section (11) at a temperature selected from the range of 40° C. to 100° C.

According to yet another embodiment of the present invention, there is provided an apparatus for manufacturing lyocell filament yarn with improved mechanical properties, the apparatus comprising:

a. at least one lyocell dope vessel (1) (e.g., 1A-1D) for storing cellulose dope;
b. at least one metering pump (2) for pumping said cellulose dope into at least one spin pack (3) containing at least one spinneret that extrudes the cellulose dope as spun filament yarn;
c. a regeneration bath (5) containing a solution for partial regeneration of the extruded spun filament yarn;
d. at least one winder (6) for stretching extruded spun filament yarn while it passes through an air-gap (4) of controlled conditions and the regeneration bath solution;
e. an individual yarn guiding drum (8) for guiding the stretched yarn from the winder (6) to a main drum (7) spinning at a speed less than the winder speed wherein the main drum speed to winder speed is selected from a ratio of 1.00 to 0.85, said main drum having a filament yarn washing section (9) and a filament yarn drying section (11) wherein the filament yarn washing section (9) comprises sequential washing zones each successive washing zone containing a washing solution of successively decreasing concentration of NMMO, said concentration successively decreasing up to 0% by weight of NMMO;
f. the filament yarn drying section (11) having a temperature selected from the range of 40° C. to 100° C. for drying the washed filament yarn; and g. a circulating pump (10) (e.g., 10*a*-10*g*) to maintain uniform concentration of the NMMO in each washing zone.

BRIEF DESCRIPTION OF THE DRAWINGS

FIG. 1 illustrates a process for manufacturing of Lyocell filament yarn using apparatus for single Lyocell filament yarn; and FIG. 2 depicts an apparatus for multiple Lyocell filament yarn, according to the embodiments of the present invention.

DETAILED DESCRIPTION OF THE EMBODIMENTS

The embodiments of the present invention eliminate or reduces the aforementioned problems of the prior art by providing a process for manufacturing continuous Lyocell filament yarn of superior mechanical properties by washing of filament yarn with sequential decrease in NMMO concentrations and filament yarn drying under relaxed conditions. Additionally, the present invention also provides a compact washing and drying apparatus that uses controlled air gap spinning thereby resulting in production of LFY under relaxed conditions and also having a higher productivity.

According to all embodiments of the present invention, the process for manufacturing of Lyocell filament yarn occurs by using continuous filament washing with sequential decrease in NMMO concentrations through multiple steps and drying at lower temperature (less than 100° C.) under relaxed conditions (less stretching of filaments) on a single winder with integrated system.

According to the present embodiments, the process for manufacturing lyocell filament yarn involves preparation of a homogenous solution of cellulose in concentrated NMMO solution to obtain cellulose dope. This cellulose dope is then stored in a lyocell dope vessel (1) and pumped via a metering pump (2) into a spin pack (3) containing a spinneret that extrudes the cellulose dope as spun filaments. Thereafter, the extruded spun filament yarn is stretched using a winder (6) while the filaments are passed through an air-gap (4) of controlled conditions and a regeneration bath (5) containing aqueous solution of NMMO for partial regeneration of the extruded spun filament yarn. The partially regenerated filament yarn are then guided to winder (6) and then filament guiding drum (8) which passes said filament yarn to a main drum (7) spinning at a speed less than the winder (6) speed, said main drum (7) having a filament yarn washing section (9) and a filament yarn drying section (11) wherein the filament yarn is fully regenerated in the filament yarn washing section (9) by passing it through sequential washing zones, each successive washing zone containing a washing solution of successively decreasing concentration of N-Methylmorpholine-N-oxide monohydrate (NMMO), said concentration successively decreasing up to 0% by weight of NMMO in filament. The washed filament yarn is then dried on the filament yarn drying section (11) at a temperature selected from the range of 40° C. to 100° C. This dried lyocell filament yarn is further wound using a yarn winding system (12) to obtain lyocell filament yarn.

In an embodiment, the solution of cellulose of initial step comprises 9% to 13% by weight of cellulose in concentrated NMMO solution, said cellulose having a degree of polymerization of less than 800.

In an embodiment, the spinneret has a length to diameter ratio of less than 2 and contains 1 to 120 holes.

In an embodiment, the air-gap conditions comprise an air temperature selected from 15° C. to 30° C., a relative humidity selected from 40% to 70%, an air gap selected from 15 mm to 50 mm and an air velocity selected from 0.3 to 3 m/sec.

In an embodiment, the solution for partial regeneration of the extruded spun filament yarn comprises NMMO of a concentration selected from 5% to 25%.

In an embodiment, the ratio of main drum speed to winder speed is selected from a ratio of 1.00 to 0.85. The washing zone solutions comprise sequentially decreasing concentrations of NMMO. The filament yarn has a tenacity greater than 3.2 grams per denier and elongation greater than 8%.

As illustrated in FIG. 1, the process involves preparation of homogenous solution of 9% to 13% by weight of cellulose in concentrated NMMO solution ('cellulose dope'). The said cellulose dope is stored in a Lyocell dope vessel (1) and this homogeneous solution is then pumped using a metering pump (2) and spun through a spinneret packed in spin pack (3). The spinneret may have 24 or 40 holes. Then extruded filaments are passed through controlled air-gap conditions (4) and then regenerated in 10-22% NMMO in water. These filaments are stretched in the air gap and regeneration bath (5) using winder (6) and then relaxed through lower speed of a main drum (7) and guided to a filament yarn guiding drum (8).

Thereafter, the filament yarn is fully regenerated on the main drum (7) using seven washing zones of different NMMO concentrations from 10% wt. to 0% wt. of NMMO in a filament washing section (9). The concentrations of NMMO in all washing zones are maintained either by counter current or co-current flow in each zone by circulating pumps (10) (e.g., 10*a*-10*g*). These fully washed filaments yarn is then dried on drying section of drum (11) using hot air (40° C. to 100° C.) and wound on bobbin in the yarn winding system (12).

In an embodiment, the mechanical properties of LFY (20 to 300 denier yarn) produced by the present process has a tenacity greater than 3.2 grams per denier and elongation greater than 8%. This filament yarn can be used for textile applications.

In the present invention, the process utilizes cellulose pulp lower than 800 DP and spinneret of L/D≤2 to produce LFY. These conditions are favourable for continuous and stable spinning using compact set up which is easy to operate and is more economical.

In an embodiment, the speed of the main drum (7) is lower than the speed of the winder (6), speed ratio (main drum speed/winder speed) is kept in the range of 1.00 to 0.85, preferably 0.90 to 0.998.

In all embodiments of the present invention, the process utilizes a compact and integrated spinning, washing and drying system for manufacturing of LFY under relaxed conditions to achieve the desired mechanical properties (tenacity>3.2 gpd and elongation>8%). The present invention has advantages of smaller plant footprint with easy to operate and scalable features.

In another embodiment of the present invention, there is provided an apparatus for producing continuous LFY having high productivity and yield, lower processing cycle, easier operation and scalability. The present invention provides a compact and integrated apparatus that has multiple spinnerets and spinning lines to produce more LFY on a single washing and drying area in order to compact the process thereby making it economical.

According to the embodiments, the apparatus comprises of at least one lyocell dope vessel (1) for storing cellulose dope, at least one metering pump (2) for pumping said cellulose dope into at least one spin pack (3) containing at least one spinneret that extrudes the cellulose dope as spun filament, a regeneration bath (5) containing a solution for partial regeneration of the extruded spun filament yarn, at least one winder (6) for stretching extruded spun filament yarn while it passes through an air-gap (4) of controlled conditions and the regeneration bath solution, an individual yarn guiding drum (8) for guiding the stretched yarn from the winder (6) to a main drum (7) spinning at a speed less than the winder speed wherein the main drum speed to winder speed is selected from a ratio of 1.00 to 0.85, said main drum having a filament yarn washing section (9) and a filament yarn drying section (11) wherein the filament yarn washing section (9) comprises sequential washing zones each successive washing zone containing a washing solution of successively decreasing concentration of NMMO, said concentration successively decreasing from 10% by weight to 0% by weight of NMMO, the filament yarn drying section (11) having a temperature selected from the range of 40° C. to 100° C. for drying the washed filament yarn and a circulating pump (10) to maintain uniform concentration of the NMMO in each washing zone.

In an embodiment, the air-gap conditions comprise an air temperature selected from 15° C. to 30° C., a relative humidity selected from 40% to 70%, an air gap selected from 15 mm to 50 mm and an air velocity selected from 0.3 to 3 m/sec.

In an embodiment, the main drum (7) is a single drum containing washing and drying sections for one to many filament yarn lines.

In an embodiment, the filament yarn drying section temperature is maintained by heating the main drum (7) or using hot air or both.

In an embodiment, the apparatus further comprises at least one yarn winding system (12) for winding said dried Lyocell Filament Yarn (LFY).

The arrangement of spinneret and polymer flow are designed and accommodated in overall set LFY spinning apparatus is shown in FIG. 2. Here, four Lyocell dope vessels (1A, 1B, 1C, 1D) are used to store the cellulose dope which is then uniformly distributed, and the conditions are maintained such that there is stable spinning of the filaments. The filament yarn is immersed in aqueous NMMO bath (5) through guides with equal residence (more or less) time and then pulled by single or four winders (6). Then these filament yarn (s) are relaxed through lower speed ratio of main drum (7) to winder. Preferably, there is a single main drum (7) that contains the integrated washing and drying areas for all four spinning lines. This results in process optimization and increase in production without increasing the plant footprint. In another embodiment, in the filament yarn washing section (9), washed with decreasing concentration of aqueous NMMO solution and the last washing is done by water. Also, the drying is performed either by heating the main drum (7) or blowing hot air or both.

In an embodiment, the apparatus involves four LFY spinning lines with effective washing and drying system, combined with winding, twisting if required, to continuously produce filament yarn, which can be used directly for textile applications. In an embodiment, drying occurs at a temperature less than 100° C., preferably around 75° C. Also, the tension in filament yarn is maintained resulting in a continuous filament yarn having better mechanical properties including a better structure of the filament and higher elongation.

EXAMPLES

Advantages and benefits of the present process according to the embodiments of the present invention would become more apparent from the below experimental details to a person skilled in the art.

Examples 1-2

The process involves preparation of homogenous solution of 13% cellulose in 76% NMMO and 11% water ('cellulose dope'). The said cellulose dope is stored in a Lyocell dope vessel and this homogeneous solution is then pumped using a metering pump and spun through a spinneret packed in spin pack at 107° C. The spinneret has 24 holes. Then extruded filaments are passed through controlled air-gap conditions (Air temperature 22° C., Relative Humidity 48%, Air gap 50 mm, Air velocity 0.6 m/sec) and then regenerated in 10% aqueous NMMO solution at 14° C. Filaments are stretched in the air gap and regeneration bath using winder and stretch on drum under different speed ratio. The complete regeneration was performed through 5 washing zones with decreasing concentration of NMMO, 5 to 0% at room temperature. The drying of filament yarn was done on drum (temperature 50° C.) and wound it on bobbin using traverse winder.

| Processing conditions | speed ratio | Denier | Tenacity (gpd) | Elongation (%) |
|---|---|---|---|---|
| Example 1 | 0.962 | 65 | 3.26 | 8.70 |
| Example 2 | 0.975 | 65 | 3.35 | 7.50 |

It shows that filament yarn regeneration under lower speed ratio (drum to winder) impact elongation & tenacity.

Examples 3-4

The process involves preparation of homogenous solution of 13% cellulose in 76% NMMO and 11% water ('cellulose dope'). The said cellulose dope is stored in a Lyocell dope vessel and this homogeneous solution is then pumped using a metering pump and spun through a spinneret packed in spin pack at 107° C. The spinneret of 100-micron diameter with L/D 2 has 24 holes. Then extruded filaments are passed through controlled air-gap conditions (Air temperature 21° C., Relative Humidity 50%, Air gap 22 mm, Air velocity 0.6 m/sec) and then regenerated in 10% aqueous NMMO solution at 13° C. These filaments are stretched in the air gap and regeneration bath using winder and further stretched on drum at speed ratio of 0.959. The complete regeneration was performed through 5 washing zones with decreasing concentration of NMMO, 5 to 0% at room temperature. The effect of drying of filament yarn was performed using hot drum and blowing hot air, and wound it on bobbin using traverse winder.

| Processing conditions | Drying mode | Denier | Tenacity (gpd) | Elongation (%) |
|---|---|---|---|---|
| Example 3 | Hot air (85° C.) | 70 | 3.23 | 9.14 |
| Example 4 | Hot drum (50° C.) | 70 | 3.28 | 7.82 |

It shows that filament yarn drying by blowing hot air and using hot drum has major impact on elongation.

The embodiments were chosen and described in order to best explain the principles of the present invention and its practical application thereby enabling others, skilled in the art, to best utilize the present invention and various embodiments with various modifications as are suited to the particular use contemplated.

We claim:

1. An apparatus for manufacturing lyocell filament yarn with improved mechanical properties, the apparatus comprising:

a) at least one lyocell dope vessel for storing cellulose dope;

b) at least one metering pump for pumping said cellulose dope into at least one spin pack containing at least one spinneret that extrudes the cellulose dope as spun filament yarn;

c) a regeneration bath containing a solution for partial regeneration of the extruded spun filament yarn;

d) at least one winder for stretching extruded spun filament yarn while it passes through an air-gap of controlled conditions and the regeneration bath solution to create a stretched yarn;

e) an individual yarn guiding drum;

f) a main drum having a filament yarn washing section and a filament yarn drying section, wherein the individual yarn guiding drum guides the stretched yarn from the at least one winder to the main drum spinning at a speed less than the winder speed, wherein the main drum speed to winder speed is selected from a ratio of 1.00 to 0.85, wherein the filament yarn washing section comprises sequential washing zones, each successive washing zone containing a washing solution of successively decreasing concentration of N-methyl morpholine N-oxide (NMMO), said concentration successively decreasing to up to 0% by weight of NMMO, and wherein the filament yarn drying section has a temperature of 40° C. to 100° C. for drying the washed filament yarn to create a dried lyocell filament yarn having a tenacity greater than 3.2 grams per denier and elongation greater than 8%; and g) a circulating pump to maintain uniform concentration of the NMMO in each washing zone.

2. The apparatus as claimed in claim 1, wherein the air-gap conditions comprise an air temperature selected from 15° C. to 30° C., a relative humidity selected from 40% to 70%, an air gap selected from 15 mm to 50 mm and an air velocity selected from 0.3 to 3 m/sec.

3. The apparatus as claimed in claim 1, wherein the main drum is a single drum containing washing and drying sections for one to four filament yarn lines.

4. The apparatus as claimed in claim 1, wherein the filament yarn drying section temperature is maintained by heating the main drum or using hot air or both.

5. The apparatus as claimed in claim 1, further comprising at least one yarn winding system for winding said dried lyocell filament yarn.

6. A process for manufacturing lyocell filament yarn with improved mechanical properties, the process comprising:

a) preparing a homogenous solution of cellulose in concentrated NMMO solution to obtain cellulose dope, and storing said cellulose dope in a lyocell dope vessel;

b) pumping stored cellulose dope via a metering pump into a spin pack containing a spinneret that extrudes the cellulose dope as spun filaments;

c) stretching extruded spun filament yarn using a winder while passing filaments through an air-gap at controlled conditions and in a regeneration bath containing a solution for partial regeneration of the extruded spun filament yarn;

d) guiding the partially regenerated filament yarn to filament guiding drum which passes said filament yarn to a main drum spinning at a speed less than the winder speed, said main drum having a filament yarn washing section and a filament yarn drying section wherein the filament yarn is fully regenerated in the filament yarn washing section by passing it through sequential washing zones, each successive washing zone containing a washing solution of successively decreasing concentration of NMMO, said concentration successively decreasing up to 0% by weight of NMMO in filament, maintained by circulating system, and e) drying the washed filament yarn on the filament yarn drying section at a temperature selected from the range of 40° C. to 100° C.;

wherein said process is carried out using an apparatus comprising:

i) at least one lyocell dope vessel for storing said cellulose dope;

ii) at least one metering pump for pumping said cellulose dope into at least one spin pack containing at least one spinneret that extrudes the cellulose dope as spun filament yarn;

iii) a regeneration bath containing a solution for partial regeneration of the extruded spun filament yarn;

iv) at least one winder for stretching extruded spun filament yarn while it passes through an air-gap of controlled conditions and the regeneration bath solution to create a stretched yarn;

v) an individual yarn guiding drum;

vi) a main drum having a filament yarn washing section and a filament yarn drying section, wherein the individual yarn guiding drum guides the stretched yarn from the at least one winder to the main drum spinning at a speed less than the winder speed, wherein the main drum speed to winder speed is selected from a ratio of 1.00 to 0.85, wherein the filament yarn washing section comprises sequential washing zones, each successive washing zone containing a washing solution of successively decreasing concentration of N-methyl morpholine N-oxide (NMMO), said concentration successively decreasing to up to 0% by weight of NMMO, and wherein the filament yarn drying section has a temperature of 40° C. to 100° C. for drying the washed filament yarn to create a dried lyocell filament yarn having a tenacity greater than 3.2 grams per denier and elongation greater than 8%; and vii) a circulating pump to maintain uniform concentration of the NMMO in each washing zone.

7. The process as claimed in claim 6, wherein the solution of cellulose of step (a) comprises 9% to 13% by weight of cellulose in concentrated NMMO solution, said cellulose having a degree of polymerization less than 800.

8. The process as claimed in claim 6, wherein the spinneret has a length to diameter ratio of less than or equal to 2 and contains 1 to 120 holes.

9. The process as claimed in claim 6, wherein the air-gap conditions comprise an air temperature selected from 15° C. to 30° C., a relative humidity selected from 40% to 70%, an air gap selected from 15 mm to 50 mm and an air velocity selected from 0.3 to 3 m/sec.

10. The process as claimed in claim 6, wherein the solution for partial regeneration of the extruded spun filament yarn comprises NMMO of a concentration from 5% to 25%.

11. The process as claimed in claim 6, wherein the dried lyocell filament yarn of step (e) is further wound using a yarn winding system to obtain lyocell filament yarn.

* * * * *